United States Patent [19]

Goff et al.

[11] Patent Number: 4,980,584

[45] Date of Patent: Dec. 25, 1990

[54] MULTI-STAGE WIDEBAND SUCCESSIVE DETECTION LOGARITHMIC AMPLIFIER

[75] Inventors: Miles E. Goff, Carlisle; David E. Meharry, Lexington, both of Mass.

[73] Assignee: Sanders Associates, Inc., Nashua, N.H.

[21] Appl. No.: 258,135

[22] Filed: Oct. 14, 1988

[51] Int. Cl.[5] ..... G06G 7/24; G06G 7/12

[52] U.S. Cl. ..... 307/492; 307/494; 307/497; 328/145

[58] Field of Search ..... 307/492, 494, 497, 490; 328/145

[56] References Cited

U.S. PATENT DOCUMENTS

| | | | |
|---|---|---|---|
| 3,605,027 | 9/1971 | Nichols | 307/492 |
| 3,668,535 | 6/1972 | Landsdowne | 307/492 |
| 3,745,474 | 7/1973 | Hughes | 307/492 |
| 4,053,842 | 10/1977 | Turski et al. | 329/103 |
| 4,255,714 | 3/1981 | Rosen | 329/103 |
| 4,506,678 | 3/1985 | Russell et al. | 128/723 |

OTHER PUBLICATIONS

Radiotron Designer's Handbook, Fourth Edition, pp. 1082–1085, 1953, Edited by F. Langford-Smith (Wireless Press for Amalgamated Wireless Valve Company, Pty. Ltd., 47 York Street, Sydney, Australia) (Reproduced and Distributed by Electron Tube Divison of Radio Corporation of America, Harrison, N.J).

*Primary Examiner*—Stanley D. Miller
*Assistant Examiner*—Trong Phan
*Attorney, Agent, or Firm*—Nutter, McClennen & Fish

[57] ABSTRACT

A successive detection logarithmic amplifier consists of multiple stages, with each stage containing a field-effect transistor (FET) which functions as both an amplifier and a detector. The FET, having an external gate biasing terminal, is biased to operate in its linear region as an amplifier. The gate-source junction of the FET, which is a diode, functions as the detector. When a signal exceeding a predetermined threshold is applied to the FET, the gate-source junction conducts current in the forward direction during the positive half-cycles of the input signal. During the negative half-cycles of the input signal, very little current flows through the gate-source diode junction. The time average of the forward current peaks produces a voltage across a resistor connected between the external gate bias terminal and ground. The voltages at the external gate bias terminals of each of the stages are summed to form a video output signal, a piece-wise linear voltage which is a logarithmically proportional to the input signal at the initial stage.

5 Claims, 3 Drawing Sheets

MULTI-STAGE WIDEBAND SUCCESSIVE DETECTION LOGARITHMIC AMPLIFIER

FIELD OF THE INVENTION

The invention relates to the field of logarithmic amplifiers and more particularly to the field of wideband successive detection logarithmic amplifiers.

BACKGROUND OF THE INVENTION

Logarithmic amplifiers are commonly used in instruments which receive signals tending to vary over a wide dynamic range. The logarithmic amplifiers, in effect, compress the dynamic range of the input signals, producing output signals whose magnitudes are logarithmically related to the magnitudes of the input signals. Thus input signals varying over an 80 dB range may be compressed, for example, to signals varying over a 20 dB range. The compressed signals may then be applied to signal processing circuitry which processes and analyses the signals without saturating or "jamming".

One technique used to produce a logarithmic output signal is commonly referred to as successive detection. Basically, a series of cascaded amplifiers are connected such that a signal applied to the first amplifier, $V_{in}$ dB, is amplified and then applied to a second amplifier in the series. The second amplifier amplifies the signal and applies it to a third amplifier in the series, and so on. The output of each amplifier is also applied to a corresponding detector through either a coupler or power splitter. The detector rectifies signals that exceed a predetermined detector threshold voltage, producing an output voltage which is proportional to the applied signal. As $V_{in}$ dB increases, the cascaded amplifiers successively saturate, that is, the last amplifier in the series saturates first, then the next to last amplifier saturates, and so on. When an amplifier saturates, it is producing a maximum output signal. Thus the corresponding detector is also producing a maximum output signal.

The amplifier/detector pairs are arranged such that when an amplifier produces a signal that saturates the succeeding amplifier, the signal also exceeds the corresponding detector threshold. The detectors associated with the saturated stages are thus producing maximum output signals and the detector preceding the saturated stages is producing an output signal which is proportional to the input signal. The detector output signals are summed to form a video output signal. The output signal, which is piece-wise linear, is approximately logarithmically related to $V_{in}$ dB.

The operation of each corresponding amplifier and detector must be matched such that when an input signal saturates an amplifier, it also exceeds the threshold of the preceding detector. Thus the detectors must be properly tuned to avoid gaps in the video output signal. The individual stages must be well matched, also, in order to operate properly over a large dynamic range and a wide bandwidth. The amplifiers and detectors are temperature sensitive, and thus matching the stages generally requires two temperature compensation schemes. First, each amplifier and corresponding detector in each stage must be separately temperature compensated, and second, each stage must be temperature compensated to ensure that all of the stages produce output signals which are related $V_{in}$ dB.

The stages are relatively complex and costly, including several components, namely, an amplifier and corresponding temperature compensating components, a detector and corresponding temperature compensating components, and a coupler or a power splitter. The stages also require special tuning and temperature matching, adding to their cost.

The cost of the stages typically limits the number of stages used to form an amplifier. Thus the video output signal produced by summing the detector output signals is a rough approximation of a signal which is logarithmically proportional to the input signal, $V_{in}$ dB. Additional video circuitry may be added to the multi-stage amplifier to smooth the output signal into a closer approximation of a signal logarithmically related to the input signal. However, such circuitry further increases the cost.

SUMMARY OF THE INVENTION

The invention is an improved wideband successive detection multi-stage logarithmic amplifier in which each stage includes a field-effect transistor (FET) which functions as both an amplifier and a detector, eliminating the need for separate detectors, couplers, and associated temperature compensation components.

Each stage includes a FET having an external gate biasing terminal. The FET is biased to operate in its linear region as an amplifier. The gate-source junction of the FET, which is a diode junction, functions as the detector. While the FET is operating in its linear region, very little current flows through the gate-source junction. However, when a signal exceeding a predetermined threshold is applied to the FET, the gate-source diode junction performs as a detector. This is also the point at which the FET starts to saturate.

More specifically, the FET is then operating in a transition region between the linear amplification region and complete saturation. The FET gate-source junction conducts forward current during the positive half-cycles of the FET input signal. During the negative signal half-cycles very little current flows through the gate source junction. The time average of the forward current peaks produces a voltage across a resistor connected between the external gate bias terminal and ground. The voltages at the external biasing terminals of the FET and succeeding FETs are summed to form the video output signal, a piece-wise linear voltage which is logarithmically proportional to the input signal at the initial stage.

The FET, operating in the transition region, is supplying an increasing signal to the succeeding FETs at the same time that it is functioning as a detector. As the FET input signal increases, the FET reaches complete saturation, providing a maximum signal to succeeding stages. The succeeding stages thus produce maximum voltages at their biasing terminals and one or more preceding stages are operating in their transition regions.

BRIEF DESCRIPTION OF THE DRAWINGS

For a more complete understanding of the features and advantages of the invention, reference should be made to the following detailed description and the accompanying drawings, in which.

DETAILED DESCRIPTION OF THE ILLUSTRATIVE EMBODIMENT

Figure 1:
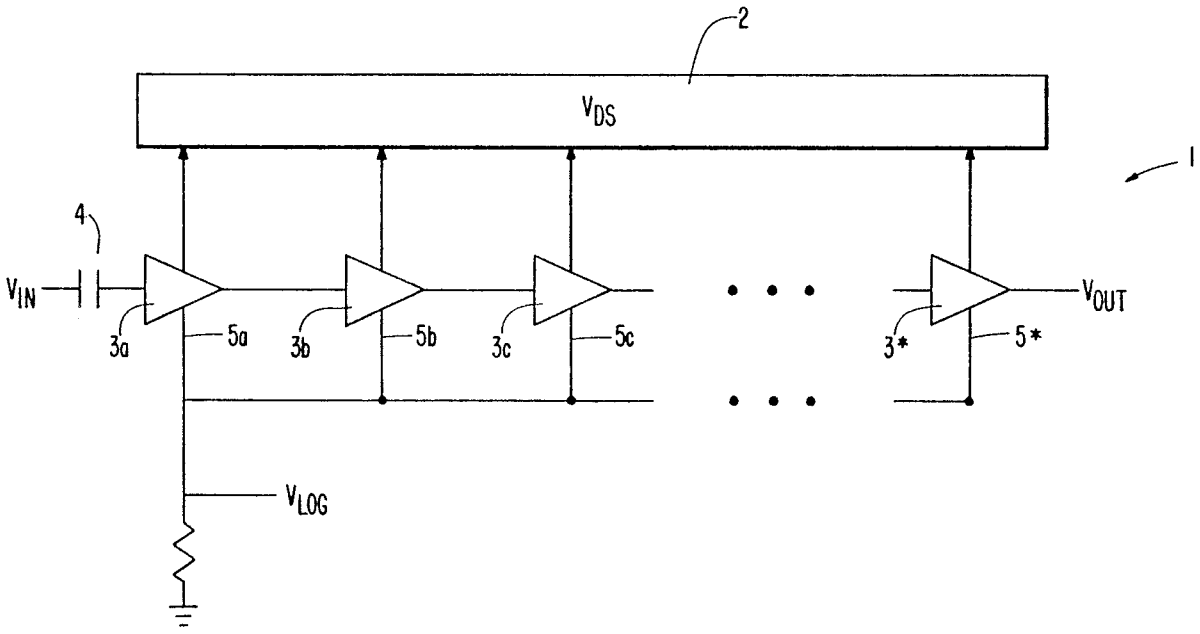
FIG. 1 is a functional block diagram of a wideband successive detection logarithmic amplifier, including a plurality of stages, constructed in accordance with the preferred embodiment.

FIG. 1 illustrates a multi-stage, successive detection logarithmic amplifier 1. The logarithmic amplifier 1 includes a DC voltage source 2 and a plurality of cascaded amplifier stages 3A-3*. A radio frequency signal, $V_{in}$ dB, is applied as an input signal to the first stage 3A through a DC blocking capacitor 4. The first stage 3A amplifies the signal and applies it to the second stage 3B. Each stage thereafter amplifies the signal and then applies it to the next stage so that the output of the last stage 3* is an amplified signal, $V_{out}$ dB, corresponding to $V_{in}$ dB.

Each stage 3 includes a FET which functions as both an amplifier and a detector, as described in more detail with reference to FIG. 3 below. As the input signal, $V_{in}$ dB, is amplified and applied to the various stages, succeeding stages 3 begin to saturate and the FETs in these stages begin conducting current through their gate-source junctions.

Each FET gate-source junction is a diode, and thus the current flows through the diode in only one direction, that is, it flows through the junction during the positive half-cycle of the input signal. This rectified current flows through a biasing network (shown in FIG. 3) connected to the gate, producing a negative voltage, $V_{log}$ dB, at an external gate biasing terminal 5.

The last stage 3* is the first stage to start saturating and the first to produce a $V_{log}$ dB signal. Thereafter, as the initial stage input signal increases, the stage preceding stage 3* saturates. When this stage completely saturates, the signal applied to stage 3* is at its maximum, and thus the voltage, $V_{log}$ dB, corresponding to the peaks of the applied signal is at its maximum. Any further increases in $V_{in}$ dB will thus not increase the corresponding $V_{log}$ dB signal. The stage immediately preceding the saturated stage is also conducting, producing a voltage at its terminal 5. This stage is not then saturated, and it is producing a voltage at the terminal 5 which is proportional to the input signal applied to the stage, and thus, proportional to $V_{in}$ dB. The terminal 5 voltages, $V_{log}$ dB, are summed to form the video output signal, $V_{LOG}$ dB.

Figure 2:
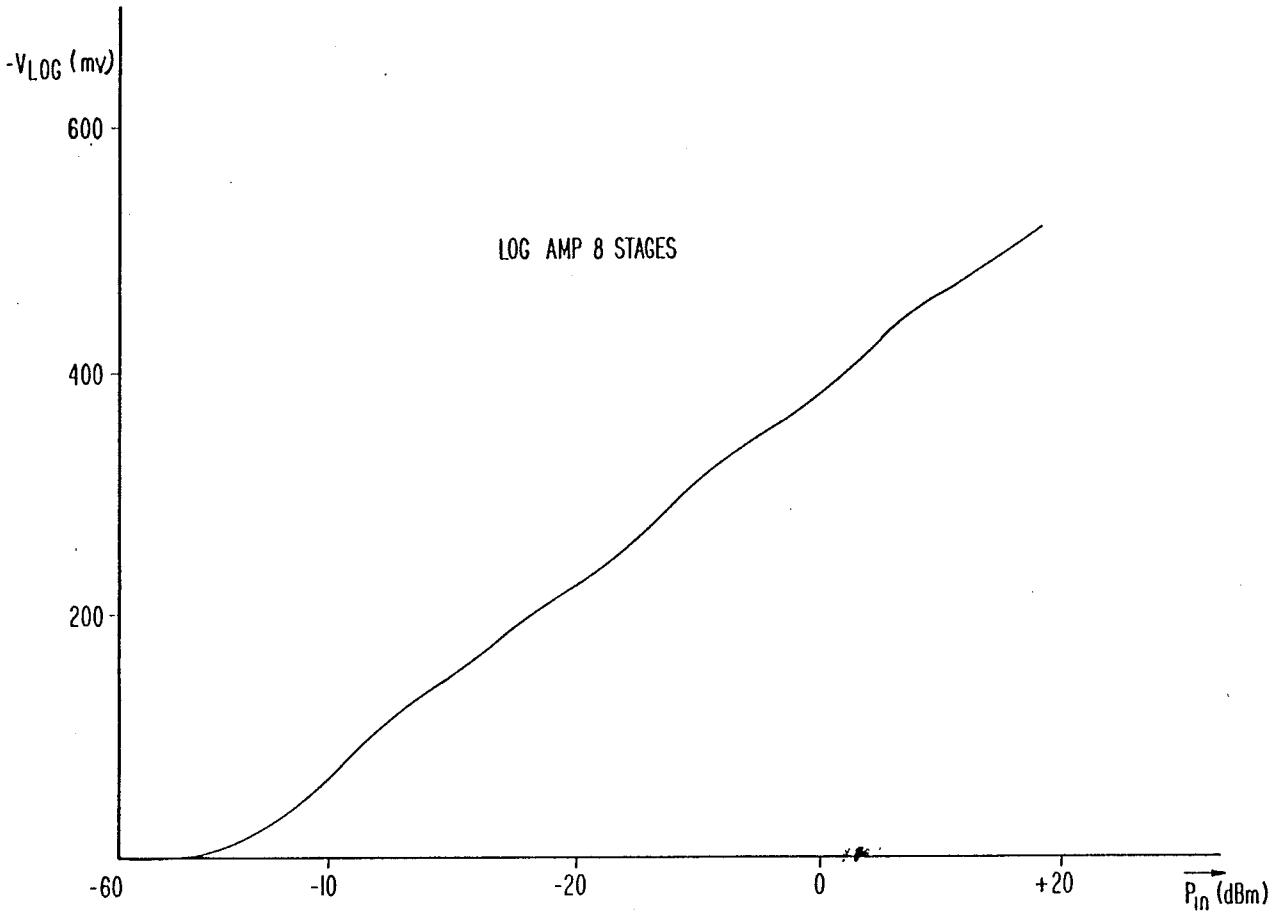
FIG. 2 is a graph of output voltage versus, input power.

Each stage is configured to produce a gain of approximately 6 dB. Once the input signal is large enough to cause the last stage 3* to saturate, each 6 dB increase in the initial input signal power causes another stage to saturate, adding its maximum voltage to $V_{LOG}$ dB. The increase in signal power also causes the preceding non-conducting stage to conduct, adding to $V_{LOG}$ dB its terminal voltage which is proportional to $V_{in}$ dB. Summing the terminal voltages produces a signal which is piece-wise linear over the signal range of each stage, and overall logarithmically related to $V_{in}$ dB over a large dynamic range and a wide bandwidth. A graph of the video signal, $V_{LOG}$ dB, versus input power is shown in FIG. 2 for an eight stage logarithmic amplifier.

Referring to, again, FIG. 1, the number of stages 3 which may be connected to form the logarithmic amplifier 1 is limited by circuit noise If the gain of each stage is large, the circuit noise may cause some of the stages to saturate, even before a $V_{in}$ dB signal is applied. Thus either the gain or the bandwidth of the individual stages is limited and several stages are used or the gain or bandwidth is not so limited and fewer stages are used.

Figure 3:
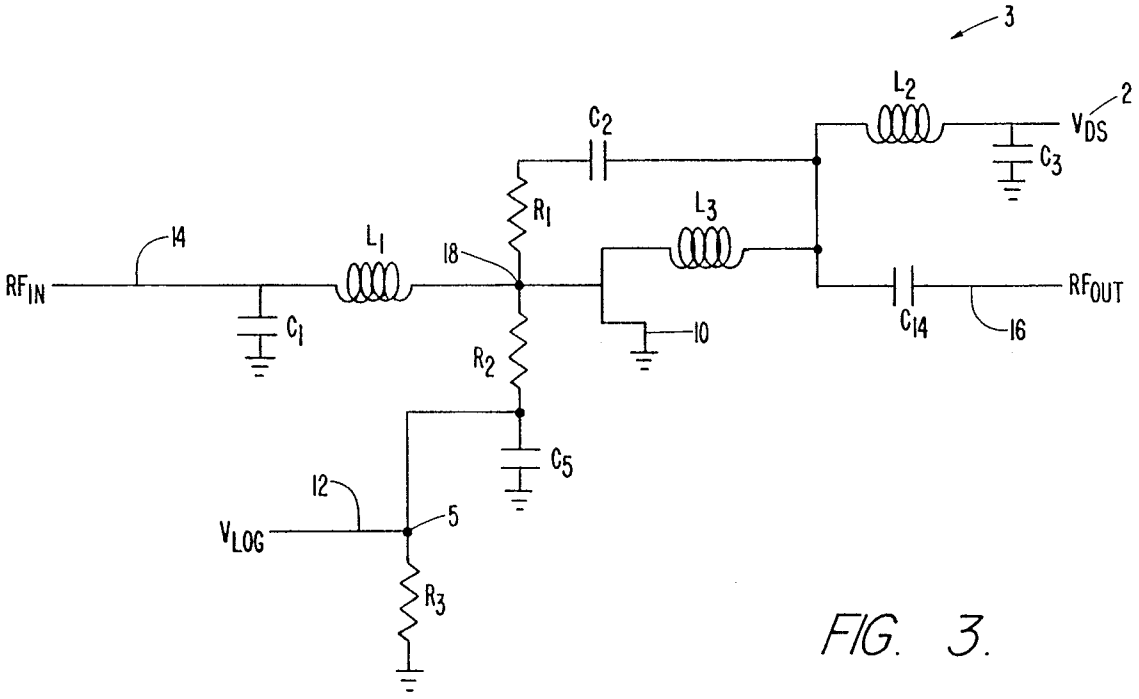
FIG. 3 is a detailed diagram of a stage of the amplifier depicted in FIG. 1.

FIG. 3 illustrates an exemplary stage 3 of the logarithmic amplifier 1 shown in FIG. 1. A FET 10 is biased to operate in the linear region by two biasing networks using conventional biasing techniques. The gate is biased to 0 dB volts DC through resistors R2 and R3, and the drain is biased to $V_{DS}$ dB through inductors L2 and L3. When an input signal $V_{in}$ dB is applied to the FET 10, feedback through the inductor L3, a capacitor C2, a resistor R1, and also through the biasing resistors R2 and R3 controls the gain. The maximum gain is set to approximately 6 dB in the preferred embodiment, however, it may be set to any value which appropriately saturates the succeeding stages and is consistent with the detection characteristic. The FET 10 amplifies the $V_{in}$ dB signal and applies it to the next stage 3 (not shown) over line 16, labeled $V_{out}$ dB, through the inductor L3 and capacitor C4.

When the input signal $V_{in}$ dB is small, the FET 10 operates as a voltage controlled current source. The gate-source junction, which is a diode, is zero biased, that is, Vgs is zero, and thus there is no current flowing from gate to source. A capacitor C5, which is alternately charged positively and negatively by the current flowing through node 18 and resistor R2 during corresponding cycles of $V_{in}$ dB stores the average value of the signal at the node 18. For small signals the average signal value is 0 dB volts.

As $V_{in}$ dB increases, the voltage at node 18 rises above the 0.5 dB to 0.8 dB volts required to forward bias the gate-source diode junction. The FET 10 thus begins to saturate and the gate-source diode junction starts to conduct. The diode junction conducts only during the positive half-cycles of the input signal. Thus current which would positively charge the capacitor C5 flows instead through the diode junction to ground, leaving the capacitor C5 negatively charged. During the negative half-cycles of the input signal, the diode junction is reverse biased and no current flows through it. A negative voltage, $V_{log}$ dB, corresponding to the charge on the capacitor C5 is produced at node 5. Node 5 is the external gate biasing terminal 5 (FIG. 1). $V_{log}$ dB is then summed, over line 12, with the corresponding voltages, $V_{log}$ dB, from the other stages to produce the video output signal, $V_{LOG}$ dB.

The FET 10 continues operating in this transition region until further increases in $V_{in}$ dB cause it to completely saturate. When the FET 10 saturates, it is producing a maximum signal, $V_{out}$ dB, which is applied as the input signal to the immediately succeeding stage. Thus the succeeding stage is producing a maximum corresponding voltage at its biasing terminal 5.

As described above with reference to FIG. 1, the stages successively saturate, and thus when a stage completely saturates the succeeding stages are already saturated and producing maximum $V_{log}$ dB voltages. One or more of the preceding stages are operating in their transition regions and are thus producing $V_{log}$ dB voltages which are proportional to $V_{in}$ dB. Each 6 dB increase in $V_{in}$ dB causes the conducting stage immediately preceding the saturated stages to completely saturate and a previously non-conducting stage to conduct. Summing the various $V_{log}$ dB voltages results in a total voltage $V_{LOG}$ dB which is piece-wise linear over the signal range of each stage and logarithmically related to $V_{in}$ dB. The logarithmic relationship is true over a wide bandwidth and a large dynamic range, as illustrated in FIG. 2.

It will be appreciated by those skilled in the art that $V_{LOG}$ dB may be formed by summing equally weighted $V_{log}$ dB voltages, as described above, or by summing weighted $V_{log}$ dB voltages. Weighting may be required if, for example, the FET characteristics vary substantially over the dynamic range of the input signal.

Using a single FET as the stage amplifier and detector substantially reduces the number of components required per stage, i.e., a separate detector and a coupler or power splitter are eliminated. Tuning of the stages, that is, tuning detectors to turn on when a succeeding stage saturates, is similarly eliminated. Also, using a single FET for signal amplification and detection necessarily means that the two functions are performed at the same temperature. Thus temperature compensation is simplified and conventional techniques may be used to temperature compensate the stages. Reducing the number of components per stage and the compensating and tuning required per stage reduces the cost of a stage, and thus, more stages may be used in an amplifier without substantially increasing the price. The more stages used in the amplifier, the better the video output signal, $V_{LOG}$ dB, approximates a logarithmic relationship to $V_{in}$ dB because there are more segments in the piecewise linear characteristic.

The smaller, less complex stages may be configured on a monolithic microwave integrated circuit (MMIC) using GaAs FETs which function well in the radio frequency signal range. The logarithmic amplifier responds well to continuous wave, or pulse modulated, radio frequency input signals, as all the detectors are DC coupled with a zero offset.

The foregoing description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed as new and desired to be secured by Letters Patent of the United States is:

1. A multi-stage successive detection logarithmic amplifier, comprising:

A. a plurality of cascaded stages with each stage including a field-effect transistor (FET) with an external gate-biasing terminal, said FET functioning as both:

i. a signal amplifier by amplifying input signals applied to it; and ii. a detector by conducting current through a gate-source junction and said external gate-biasing terminal when the amplitude of the applied input signal is above a predetermined level, said current being related to the amplitude of the applied input signal; and B. a resistive network connected to the external gate-biasing terminals of all of said FETs for producing a voltage corresponding to the total current through said gate-source junctions of all of said FETs, the voltage being logarithmically related to the amplitude of the input signal applied to the first stage of the amplifier.

2. The successive detection logarithmic amplifier of claim 1, wherein said predetermined level is the signal amplitude at which said FET begins to saturate.

3. The successive detection logarithmic amplifier of claim 2, wherein the FET in each stage is biased to begin to operate in its saturation region when the FET in a succeeding stage saturates.

4. A successive detection logarithmic amplifier comprising multiple cascaded stages, wherein each stage includes:

A. a field-effect transistor (FET) biased to operate as an amplifier in its linear region and as a detector in its saturation region, said FET conducting current through its gate-source junction which corresponds to the amplitude of input signals applied to said FET when it is operating as a detector;

B. an external gate-biasing network connected to the gate of said FET, said network producing a voltage corresponding to the current through the gate-source junction;

said amplifier further including a summer for summing the voltages at the external gate-biasing networks of all the stages, the summer producing an output signal which is logarithmically related to the amplitude of a signal applied to the first stage of the amplifier.

5. The successive detection logarithmic amplifier of claim 4, wherein each FET is biased to begin to operate in its saturation region when the FET in a succeeding stage saturates.

* * * * *